US005676307A

United States Patent [19]

Martin

[11] Patent Number: 5,676,307

[45] Date of Patent: Oct. 14, 1997

[54] CARD HAVING MAGNETIC SHEET SECURED TO ONE SURFACE AND HAVING A RAMP TO FACILITATE MAILING

[75] Inventor: John J. Martin, Louisville, Ky.

[73] Assignee: Crane Productions, Inc., Louisville, Ky.

[21] Appl. No.: 719,862

[22] Filed: Sep. 25, 1996

[51] Int. Cl.[6] ..... B65D 27/00

[52] U.S. Cl. ..... 229/92.8

[58] Field of Search ..... 229/92.8, 92.1, 229/69

[56] References Cited

U.S. PATENT DOCUMENTS

| | | | |
|---|---|---|---|
| 1,886,669 | 11/1932 | Gillespie | 229/92.8 |
| 4,957,311 | 9/1990 | Geisenheimer | 229/92.8 X |
| 5,078,314 | 1/1992 | Shibahara | 229/92.8 |
| 5,458,282 | 10/1995 | Martin | 229/92.8 |

OTHER PUBLICATIONS

The 1990 Catalog of Magnet, Inc.

A 1990 Promotional Mailer of Magnet, Inc.

*Primary Examiner*—Jes F. Pascua

*Attorney, Agent, or Firm*—Middleton & Reutlinger; James C. Eaves, Jr.

[57] ABSTRACT

The present invention relates to a card having magnetic sheet secured to one surface and having a ramp to facilitate mailing. The ramp helps mail properly pass through high speed postal sorting equipment, for example, so as to prevent the edge of a magnetic strip on one card from interfering with other mail to prematurely stop that other mail and cause the machine to jam, particularly when the mail is being restacked after sorting.

20 Claims, 4 Drawing Sheets

CARD HAVING MAGNETIC SHEET SECURED TO ONE SURFACE AND HAVING A RAMP TO FACILITATE MAILING

BACKGROUND OF THE INVENTION

1. Field of the Invention

The present invention relates to a card having magnetic sheet secured to one surface and having a ramp to facilitate mailing. The ramp helps mail properly pass through high speed postal sorting equipment, for example, so as to prevent the edge of a magnetic strip on one card from interfering with other mail to prematurely stop that other mail and cause the machine to jam, particularly when the mail is being restacked after sorting.

2. Discussion of the Prior Art

My U.S. Pat. No. 5,458,282 teaches a card having magnetic sheet secured to one surface. While this card can be used for pre-sorted bulk delivery, the card can not pass through high speed postal equipment used, for example, in processing first class mail. The edge of the magnetic strip 24 adjacent the perforation line 18 has a lip the thickness of the magnetic strip which would deter stacking the next card or other mail in the sorter on top of that card.

SUMMARY OF THE INVENTION

The present invention is for a card having magnetic sheet secured to one surface and having a ramp to facilitate mailing. More particularly, the card of the present invention comprises a planar blank having a first side and a second side, the first side being opposed to the second side; the planar blank further having a first section and an adjacent second section; a magnetic strip having an outer magnetic side and an opposed adhesive side, the adhesive side being adhesively adhered to the first side in the second section; and, means for ramping from the planar blank to the outer magnetic side of the magnetic strip, where when a first card is passing across the first side of a second card from the first section toward the second section, the ramping means facilitates the passing across. The magnetic strip may be beveled, shaved, or stamped to produce the ramping means or an external adhesive strip may be employed. If an external strip is employed, the strip may have adhesive on two sides and not therebetween, or the strip may have adhesive thereacross with a non-adhesive backing portion covering a mid-portion of the strip. This prevents that portion from adhering to the planar blank and defeating the ramp function.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
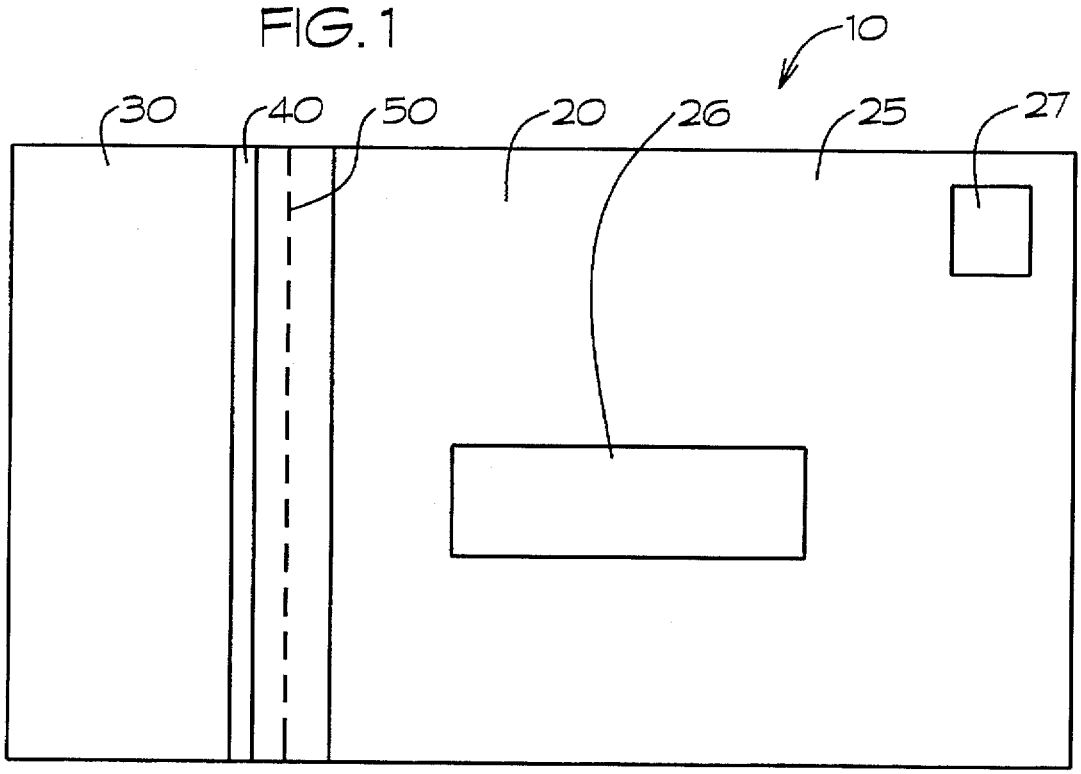
FIG. 1 is a front view of a card of the present invention.
Figure 2:
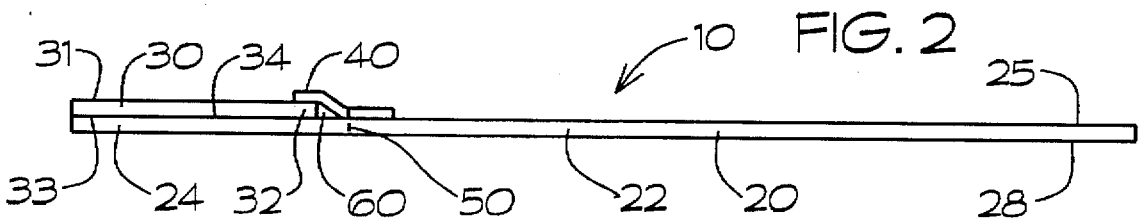
FIG. 2 is a side view of the card of FIG. 1.

With reference to FIGS. 1 and 2, the magnetic card 10 having a ramp for mailing is shown. The thicknesses of the components shown in the figures are not to scale, for ease of understanding. However, preferred dimensions are provided herein.

Card 10 includes a planar blank or substrate 20 having a first section 22 and a second section 24. Perforation line 50 divides substrate 20 into sections 22 and 24. Substrate 20 can be of any suitable material, for example, paper or plastic. Substrate 20 will be typically approximately 8 mils thick for first class United States mailing.

FIG. 1 shows the address side 25, or first side, of card 10. This side 25 will be facing the postal sorter and, therefore, includes address and postage information. Side 25 has the address thereon in section 22. The address can be printed on the substrate 20 or be on a label attached to the substrate 20, such as shown as mailing label 26. Postage can be included in section 22 as required by the post office, for example, by stamp 27. Other postage means may be used, such as postal meter labels and preprinted postage information directly on the substrate 20.

FIGS. 1 and 2 show the magnetic portion 30 included on address side 25 in the second section 24. The magnetic strip material used is preferably approximately 15 mils thick, or approximately twice the thickness of the substrate 20. Magnetic portion 30 includes a outer magnetic side 31 and an adhesive side 33. Adhesive 34 is used to attach adhesive side 33 to section 24 on the second side 28 of substrate 20, side 28 being opposed to first side 25.

Magnetic strip 30 includes a ramp edge 32. Typically, ramp edge 32 is roughly transverse to side 25 of substrate 20. Mail, including cards 10, must pass individually through the post office high speed sorting equipment. After sorting, the individual mail items are stacked one on top the other. Without more, ramp edge 32 can cause the mail being stacked to jam, as the ramp edge 32 of an underneath card might "catch" the edge of the mail item being stacked thereon. This is unsatisfactory. Therefore, ramping material 40 is provided. One-half inch wide transparent tape having a thickness of 1.6 mils has proven to be a preferred material. About one-half of material 40 is attached to substrate 20, about one-fourth of material 40 is attached to magnet 30 and the remaining about one-fourth forms the ramp between magnet 30's side 31 and substrate 20's side 25. Gap 60, a roughly triangular shaped gap is formed by substrate 20, ramp edge 32, and material 40. The angle between the substrate 20 and material 40 is desirably less than 15° and preferably about 8.5°±2°. This angle permits a mail item to stack atop the previous card without jamming. Perforation line 50 passes through substrate 20 and material Ramping material 40 may have a non-adhesive portion between the portion adhered to the magnetic strip 30 and the portion adhered to the substrate 20. This can be accomplished by only having adhesive on those adhering portions and having no adhesive therebetween. Alternatively, a thin backing strip can be attached to the material 40 where it is not to adhere to the magnetic strip 30 or substrate 20. For example, ramping material 40 could be a transparent tape having a backing thereon. The backing could be a three-piece cut backing, such that the two outer pieces of backing are removed to adhere the tape to the magnetic strip 30 and the substrate 20, leaving the backing portion therebetween. This would prevent deformation of the gap 60 by having the tape in that portion not stick to the substrate.

Opposed to side 25 is coupon/advertising side 28. For example, the section 24 portion of side 28 opposite the magnetic strip 30 can include an advertiser's name and phone number. The section 22 portion of side 28 can include any desired information, for example, one or more coupons to be redeemed, a calender, a price list, or a telephone list. When this portion has been used or becomes out-dated, section 22 can be removed from section 24, leaving section 24 for use, for example, as a refrigerator magnet with name and phone number information. For example, even if the coupons have been used or expired, the name and phone number is still there to call.

Figure 3:
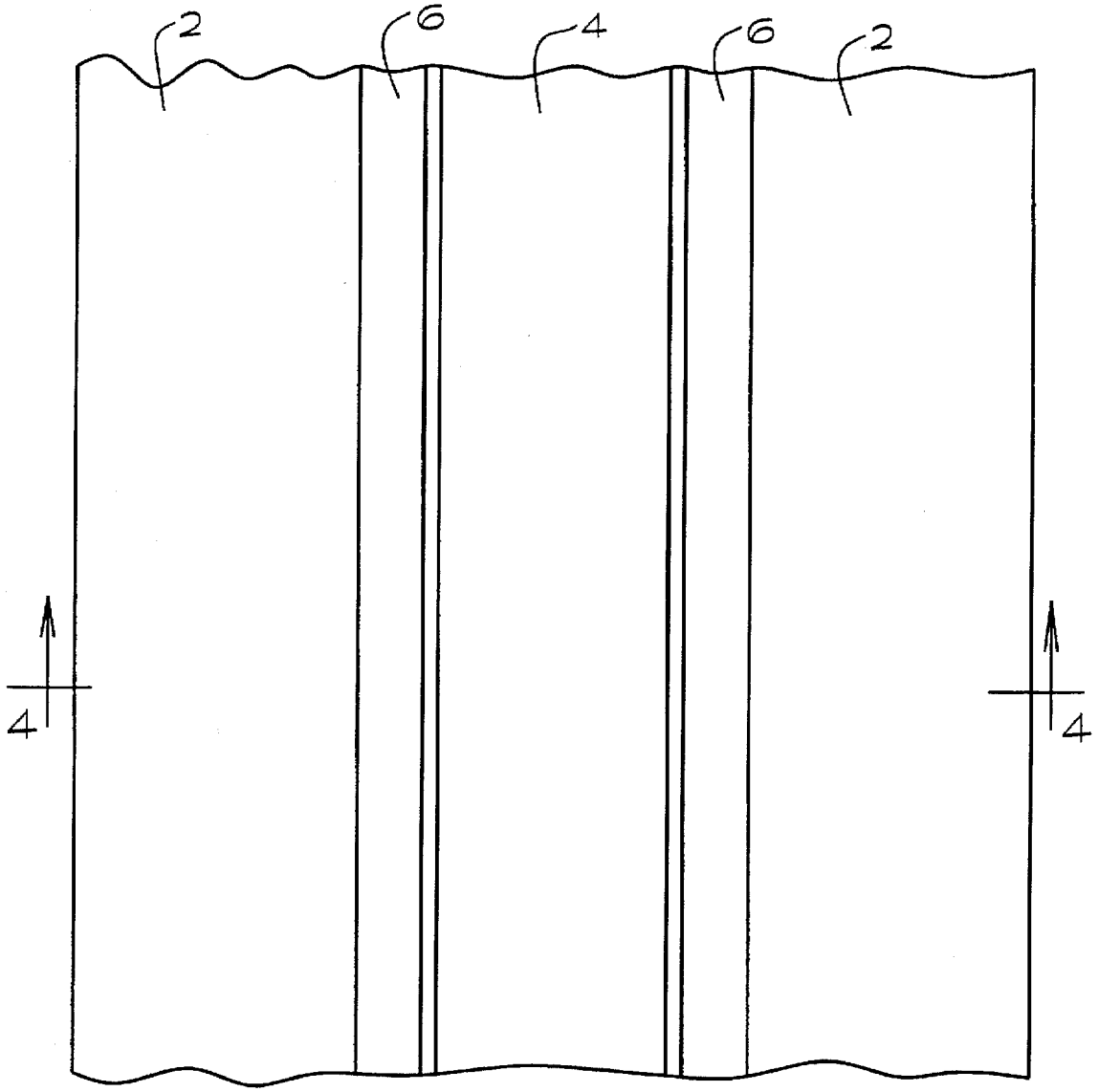
FIG. 3 is a front view of card stock with magnetic sheet material and ramp material being attached thereto.
Figure 4:
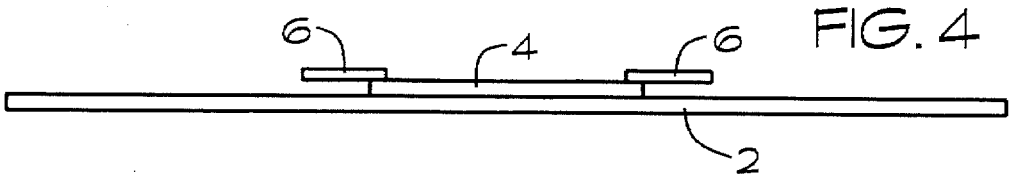
FIG. 4 is a side view of the stock of FIG. 3 along the lines 4—4.

The preferred process for making cards 10 is shown in FIGS. 3–6. FIGS. 3 and 4 shows the stock 2, magnetic strip material 4, and ramping material 6 from which the various cards 10 are formed. From one width of stock 2 and magnetic strip material 4 two cards are formed, as the magnetic strip material 4 is placed down the center of the stock 2 and then cut lengthwise down the middle.

Magnetic strip material 4 preferably is in a roll having adhesive 34 attached thereto. A protective removable layer or backing, not shown, usually engages the adhesive 34 and is removed before affixing the magnetic strip material 4 to the stock 2. The magnetic strip material 4 has a piece of ramping material 6 attached to it along each edge. As was previously mentioned, about one-fourth of the width of the ramping material 6 is attached to the magnetic strip material 4. The magnetic strip material 2 with the attached ramping material 6 is attached to the stock 2. This attachment does not attach the ramping material 6 to the stock 2. This is shown in FIGS. 3 and 4.

Figure 5:
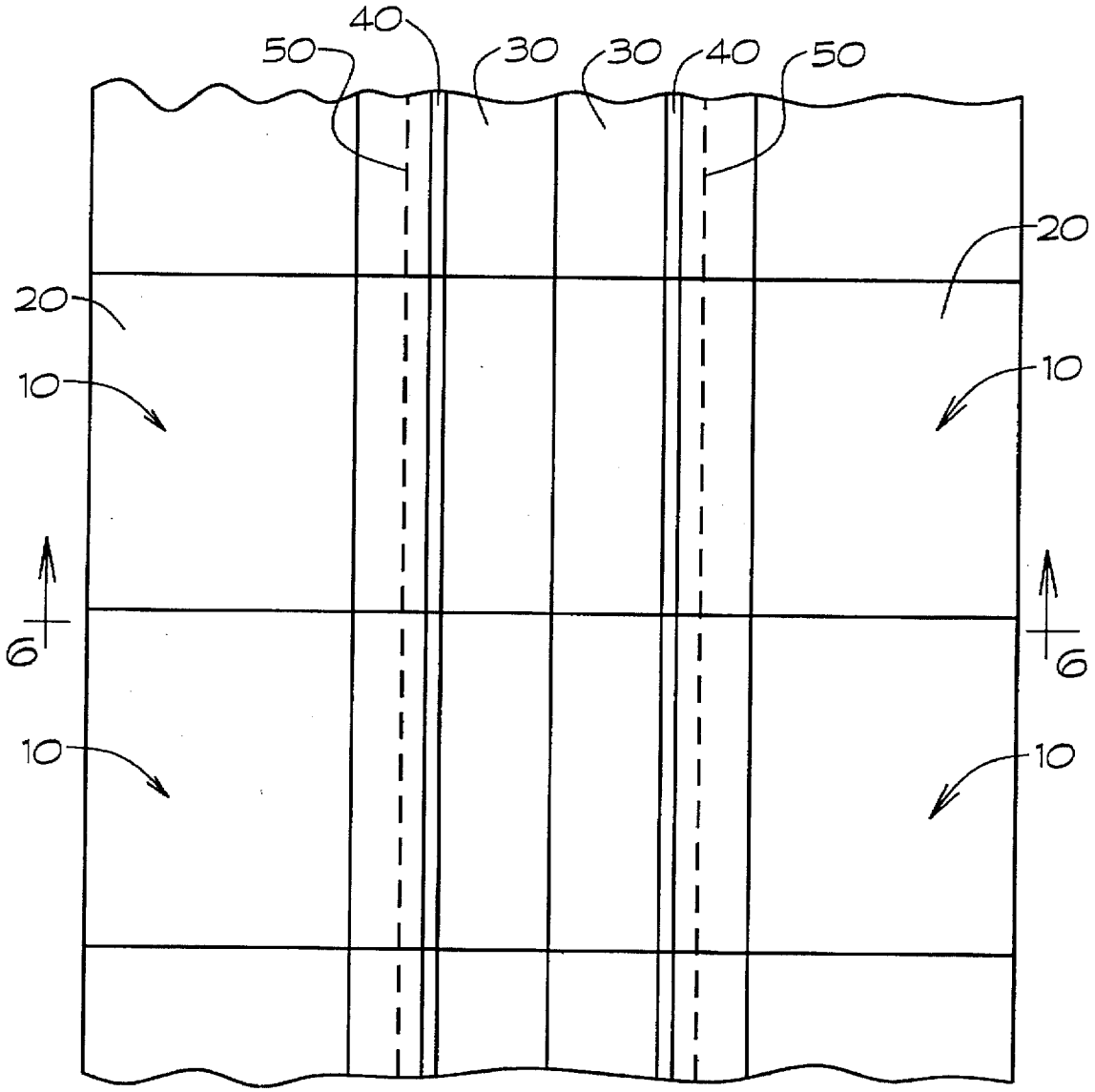
FIG. 5 is a front view of the stock of FIG. 3 after pressing, cutting, and perforating.
Figure 6:
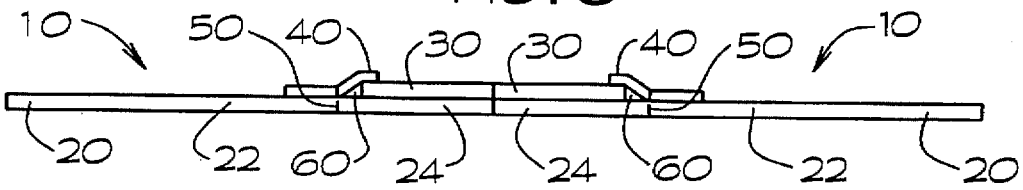
FIG. 6 is a side view of the stock of FIG. 5 along the lines 6—6.

With reference to FIGS. 5 and 6, attachment of the ramping material 6 to stock 2, perforating, and cutting are shown. About one-half the width of each piece of ramping material 6 is pressed against stock 2 to attach it thereto. If desired, ramping material 6 could have a non-adhesive portion, such that only the one-quarter engaging the magnetic strip material 4 and the opposed one-half engaging the stock 2 had adhesive thereon. The one-quarter portion therebetween could be non-adhesive such that rough handling would not destroy gap 60 by having that one-quarter portion adhere to stock 2. Perforation then occurs along about the center of each piece of ramping material 6. The act of forming the perforations 50 by cutting down through material 6 and stock 2 helps stretch ramping material 6 creating gaps 60. The stock 2 with magnetic strip material 4, and ramping material 6 attached thereto is cut to form the individual cards 10, as shown in FIG. 5. Additional coupon perforations can be made, as shown in the next embodiment.

Figure 7:
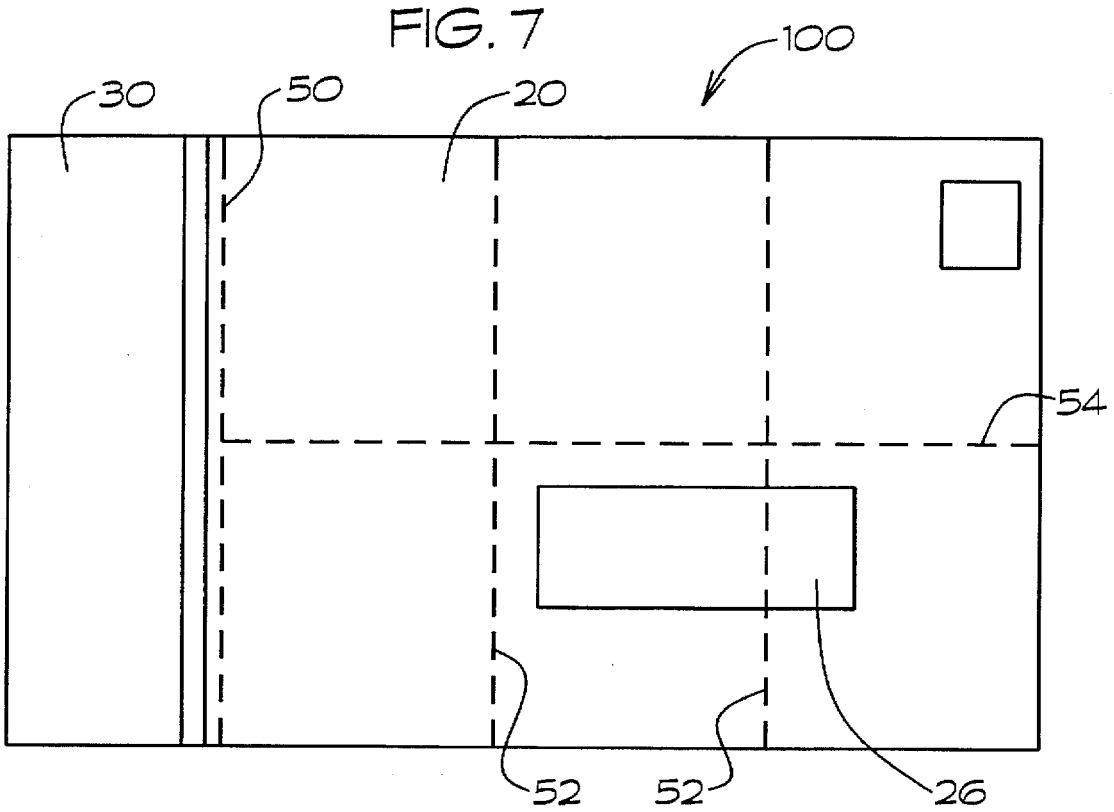
FIG. 7 is a front view of an alternative embodiment card.
Figure 8:
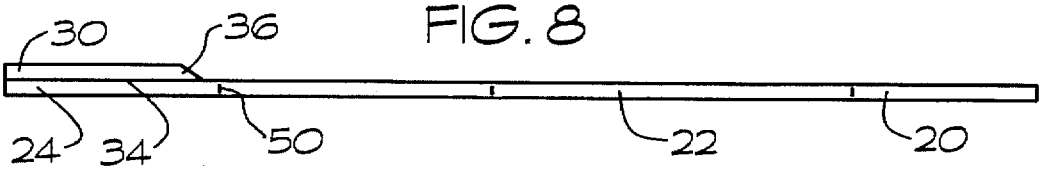
FIG. 8 is a side view of the card of FIG. 7.

FIGS. 7 and 8 show an alternative embodiment incorporating multiple additional features, an alternative ramp and additional coupon perforations. With the embodiment of FIGS. 1–6, ramping material 6 is used to make the ramp between the substrate 20 and the magnetic strip 30. As an alternative, the ramp edge 32 of FIGS. 1–6 can be beveled, shaved, stamped, or otherwise modified, to create a non-transverse sloped ramp 36. However, while this sloped ramp 36 can help prevent mail from jamming in the stacking operation, the take off ramp angle from the substrate up the magnetic strip ramp will generally exceed the about 8.5° desired and achieved with the additional ramping material 40, as explained earlier. Ramping material 40 or sloped ramp 36 comprise a means for ramping from the substrate to the outer magnetic side of the magnetic strip.

FIGS. 7 and 8 demonstrate how section 22 can be perforated to provide a plurality of coupons, for example. As shown, vertical perforations 52 and horizontal perforations 54 divide section 22 into six coupons. When the card 100 is mailed and received by the recipient, the card 100 can be placed, for example, onto a refrigerator and held thereon by the magnetic strip 30. The coupons can be used and the remaining magnetic strip and section 24 left on the refrigerator for future reference to the information printed on the side 28 of section 24.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A card, comprising:

(a.) a planar blank, said planar blank having a first side and a second side, said first side being opposed to said second side; said planar blank further having a first section and a second section, said first section being adjacent said second section;

(b.) a magnetic strip, said magnetic strip having an outer magnetic side and an opposed adhesive side, said adhesive side of said magnetic strip being adhesively adhered to said first side in said second section; and, (c.) means for ramping from said planar blank to said outer magnetic side of said magnetic strip, where when a mail item is passing across said first side of said card from said first section toward said second section, said ramping means facilitates said passing across.

2. The card of claim 1, said means for ramping comprising an adhesive strip, said adhesive strip being adhered to said outer magnetic side of said magnetic strip and being adhered to said first section of said first side at a preselected location from said magnetic strip, said preselected location being a first distance from said magnetic strip, where a gap is created between said adhesive strip and said planar blank between said magnetic strip and said preselected location.

3. The card of claim 2, where said magnetic strip has a thickness and where said first distance has a value of between seven and eighteen times said thickness.

4. The card of claim 2, where said magnetic strip has a thickness and where said first distance has a value of between 7.6 and 12.4 times said thickness.

5. The card of claim 2, where said magnetic strip has a thickness and where said first distance has a value approximately 10 times said thickness.

6. The card of claim 2, where an angle is created between said adhesive strip and said planar blank at said preselected location, said angle having a value of 15 degrees or less.

7. The card of claim 6, where said angle has a value of between 6½° and 10½°.

8. The card of claim 6, where said angle has a value of approximately 8½°.

9. The card of claim 2, where said adhesive strip includes a non-adhesive portion between said portion adhered to said magnetic strip and said portion adhered to said planar blank.

10. The card of claim 1, said means for ramping comprising an adhesive strip, said adhesive strip having a left quarter portion, a left center quarter portion, and a right half portion, said left quarter portion being adhered to said outer magnetic side of said magnetic strip, said right half portion being adhered to said first section of said first side.

11. The card of claim 10, said adhesive strip and said planar blank having a perforation line therethrough at a location between said adhesive strip left center quarter portion and said right half portion.

12. The card of claim 11, where said perforation line divides said planar blank into said first section and said second section.

13. The card of claim 10, where an angle is created between said adhesive strip and said planar blank, said angle having a value of 15 degrees or less.

14. The card of claim 13, where said angle has a value of between 6½° and 10½°.

15. The card of claim 13, where said angle has a value of approximately 8½°.

16. The card of claim 11, where an angle is created between said adhesive strip and said planar blank, said angle having a value of 15 degrees or less.

17. The card of claim 16, where said angle has a value of between 6½° and 10½°.

18. The card of claim 1, said means for ramping comprising a beveled edge of said magnetic strip along a side of said magnetic strip facing said first section of said planar blank.

19. The card of claim 1, said means for ramping comprising a shaved edge of said magnetic strip along a side of said magnetic strip facing said first section of said planar blank.

20. The card of claim 1, said means for ramping comprising a stamped edge of said magnetic strip along a side of said magnetic strip facing said first section of said planar blank.

* * * * *